US006488120B1

(12) United States Patent
Longsworth

(10) Patent No.: US 6,488,120 B1
(45) Date of Patent: Dec. 3, 2002

(54) FAIL-SAFE OIL LUBRICATED HELIUM COMPRESSOR UNIT WITH OIL-FREE GAS DELIVERY

(75) Inventor: Ralph C. Longsworth, Allentown, PA (US)

(73) Assignee: SHI-APD Cryogenics, Inc., Allentown, PA (US)

( * ) Notice: Subject to any disclaimer, the term of this patent is extended or adjusted under 35 U.S.C. 154(b) by 14 days.

(21) Appl. No.: 09/662,535

(22) Filed: Sep. 15, 2000

(51) Int. Cl.[7] ..... F01M 1/00
(52) U.S. Cl. ..... 184/6.17; 184/6.16
(58) Field of Search ..... 184/6.16, 6.17; 62/6

(56) References Cited

U.S. PATENT DOCUMENTS 3,719,573 A * 3/1973 Kawahata ..... 204/176
4,693,736 A * 9/1987 Klusmier ..... 62/6
4,949,546 A * 8/1990 Klusmier et al. ..... 62/6
4,967,572 A * 11/1990 Strasser ..... 62/467
5,379,600 A * 1/1995 Moritsu et al. ..... 62/47.1

* cited by examiner

*Primary Examiner*—Chong H. Kim
(74) *Attorney, Agent, or Firm*—Katten Muchin Zavis Rosenman

(57) ABSTRACT

In an oil-lubricated helium compressor unit, the adsorber can retain all of the oil that might be transferred from the compressor to the adsorber before the system shuts down. No oil is ever transferred or transferable to, for example, the expander in a GM type refrigeration system connected to the unit. The compressor itself will shut down because of a protective switch or seize for lack of oil before any oil carries outside the compressor unit. The unit and the connected refrigeration system can run for more than a selected design life before the compressor shuts down because the limit of oil in the adsorber has been reached. The adsorber can retain as much oil as might leave the compressor over the life of the system plus a safety margin of at least 25%. The adsorber need not be serviced or replaced for the life of the system.

12 Claims, 5 Drawing Sheets

FAIL-SAFE OIL LUBRICATED HELIUM COMPRESSOR UNIT WITH OIL-FREE GAS DELIVERY

BACKGROUND OF THE INVENTION

This invention relates generally to helium compressor units for use in cryogenic refrigeration systems and, more particularly, to an oil-lubricated helium compressor unit that is fail-safe in that pressurized oil-free helium gas is delivered over the extended life of the unit. Oil-lubricated air conditioning compressors have become standard for delivering pressurized helium to GM type cryogenic refrigerators. The ability to use these relatively inexpensive but reliable compressors results from the development of oil separators and adsorbers that reliably keep oil out of the cold expander of a GM type refrigeration system for periods of several years.

At present, GM refrigerator manufacturers recommend replacing the adsorber at 10,000 to 30,000 hour intervals. This time interval depends on the rate at which oil carries over from an oil separator that receives the high-pressure gas discharge from the oil-lubricated compressor. Oil carryover in the refrigerant gas from the separator goes to an adsorber. The capacity of the adsorber for holding oil, and the degree of risk a user is willing to accept before replacing the adsorber(s) determine the time interval without failure. Carryover of oil from the adsorber would allow oil entrained in the refrigerant gas to carry into the cold end of the system, where the oil adversely affects performance of the GM type expander. It is relatively expensive to clean up the oil once it is in the cold end of the GM refrigeration unit.

In order to avoid the risk of oil carryover, manufacturers and users tend to be conservative by allowing for a good margin of uncertainty in predicting adsorber life. Compressor manufacturers are also conservative in designing the sump of the compressor to hold enough oil so that a considerable amount of oil can be lost from the compressor before the bearings are starved of oil and in danger of seizing.

A data analysis of compressor units manufactured by the assignee of the present invention indicates that such compressor units for cryogenic systems using helium gas typically hold two to three times as much oil as the adsorber can physically retain. Thus, unless there is a program to shut down compressor operation before the adsorber is filled, an inherent danger exists for carryover of oil from the adsorber to the cold end of a connected system. Fluctuations in oil level in the compressor due to changes in ambient temperature, while small, may still require consideration when charging a compressor with oil.

Oil is typically added to a compressor when the adsorber is replaced for the third or fourth time. This oil addition is intended to make up for oil that is removed with the adsorber. However, there is considerable uncertainty in knowing how much oil, if any, to add to the compressor; and sometimes the compressor is overcharged with oil.

Recent improvements in the design of oil separators have resulted in oil carryover rates to the adsorber being less than 20 grams per year for a ten cubic feet per minute helium compressor that draws about 6 kilowatts of power. The sump in this compressor holds about 1500 grams of oil. Therefore, it would take approximately 75 years (1500÷20) to lose enough oil for the bearings to seize. A reasonably sized adsorber can hold about 500 grams of oil so that it is reasonable to recommend that the adsorber be left in place for the normal 10-year life of the system (500÷20=25). For operation beyond ten years, it is generally recommended that the adsorber be replaced; but there is no actual need to add oil when starting with 1500 grams of oil. Clearly everything is overdone, giving a sense that failures (oil carried beyond the adsorber) are avoided.

Having a ten-year service interval based on the adsorber size can reduce ongoing service cost, but does not remove the risk of oil carryover in the event that the oil separator or oil return circuit has a failure. If the adsorber can hold all of the oil that might leave the compressor before the system shuts down, and retain all of the oil when it enters the adsorber at the high rate that might exist when there has been a failure in the oil separator, then the risk of oil carryover from the adsorber is non-existent despite a separator failure. The oil entrainment rate for the conventional compressor, used in the numerical example described above, might be as high as 120 grams per hour. Therefore, the adsorber must be able to collect oil, in that example at this rate (120 grams per hour) without any carryover to the cold end.

What is needed is an oil-lubricated helium compressor unit that operates over an extended life on an oil charge that is sufficient for the desired life but is limited so that the normal carryover does not exceed the capacity of the adsorber and in the event of a failure of the oil separator does not allow oil to carryover to the expander.

SUMMARY OF THE INVENTION

Generally speaking, in accordance with the invention, a fail-safe oil-lubricated helium compressor unit is provided having extended life with oil-free delivery of compressed helium.

In the oil-lubricated helium compressor unit in accordance with the invention, the adsorber is sized so that all of the oil that might be transferred from the compressor to the adsorber before the system shuts down can be retained by the adsorber. No oil is ever transferred or transferable out of the unit to, for example, the expander in a GM type refrigeration system. Thus, the compressor itself will shut down because of a protective switch or even seize for lack of oil before any oil carries outside the compressor unit. Components are sized so thatm under normal circumstances, the unit and the connected refrigeration system can run for more than a selected design life, for example, ten years, before the compressor shuts down because the limit of oil that can be transferred to the adsorber has been reached.

Recognizing that safety factors must be given consideration when sizing and charging components, an ability to run for a predetermined life before the compressor system shuts down can be interpreted that:

(a) The adsorber is sized to retain as much oil as might leave the compressor over the life of the system plus a safety margin of at least approximately 25%.

(b) Should there be a failure of the oil separator or compressor oil return mechanism, then the adsorber retains the oil which enters at the maximum rate that can leave a failed oil separator which may be the same rate that the oil leaves the compressor. In other words, operation is without any carryover from the adsorber, terminating in compressor shut-down.

(c) For an x-year life, the oil separator is efficiently effective so that less than 100/x percent of the oil is transferred from the compressor to the adsorber under normal operation each year. Also, there must be sufficient oil initially that can be transferred from the compressor to the adsorber for x years of operations under those conditions. In other words, for a 10-year life, less than 10% of the oil is "lost" from the compressor and retained by the adsorber per year.

(d) The adsorber needs no service over an x-year period. Therefore, the separator and adsorber may be combined in a single vessel.

Accordingly, it is an object of the present invention to provide an improved oil lubricated compressor unit with an adsorber capable of holding the entire anticipated net oil output of the compressor during the intended life of the unit.

Another object of the invention is to provide an improved oil-lubricated helium compressor unit having an adsorber capable of absorbing oil at a rate equal or greater than the maximum rate that it might enter the adsorber.

Still another object of the invention is to provide an improved oil-lubricated helium compressor unit that can operate for at least ten years without risk of failure due to oil carryover into an associated refrigeration system.

A further object of the invention is to provide an improved oil-lubricated helium compressor unit with an adsorber that can contain all of the lubricating oil that might be pump-out of the compressor and retained by the adsorber.

Yet another object of the invention is to provide an improved oil-lubricated helium compressor unit that is more economical to produce than prior art units.

Still other objects and advantages of the invention will be apparent from the specification.

The invention accordingly comprises the several steps and the relation of one or more of such steps with respect to each of the others, and the apparatus embodying features of construction, combinations of elements, and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the inventions, reference is made to the folloiwng description taken in connection with the accompanying drawing in which.

DESCRIPTION OF PREFERRED EMBODIMENTS

Figure 1:
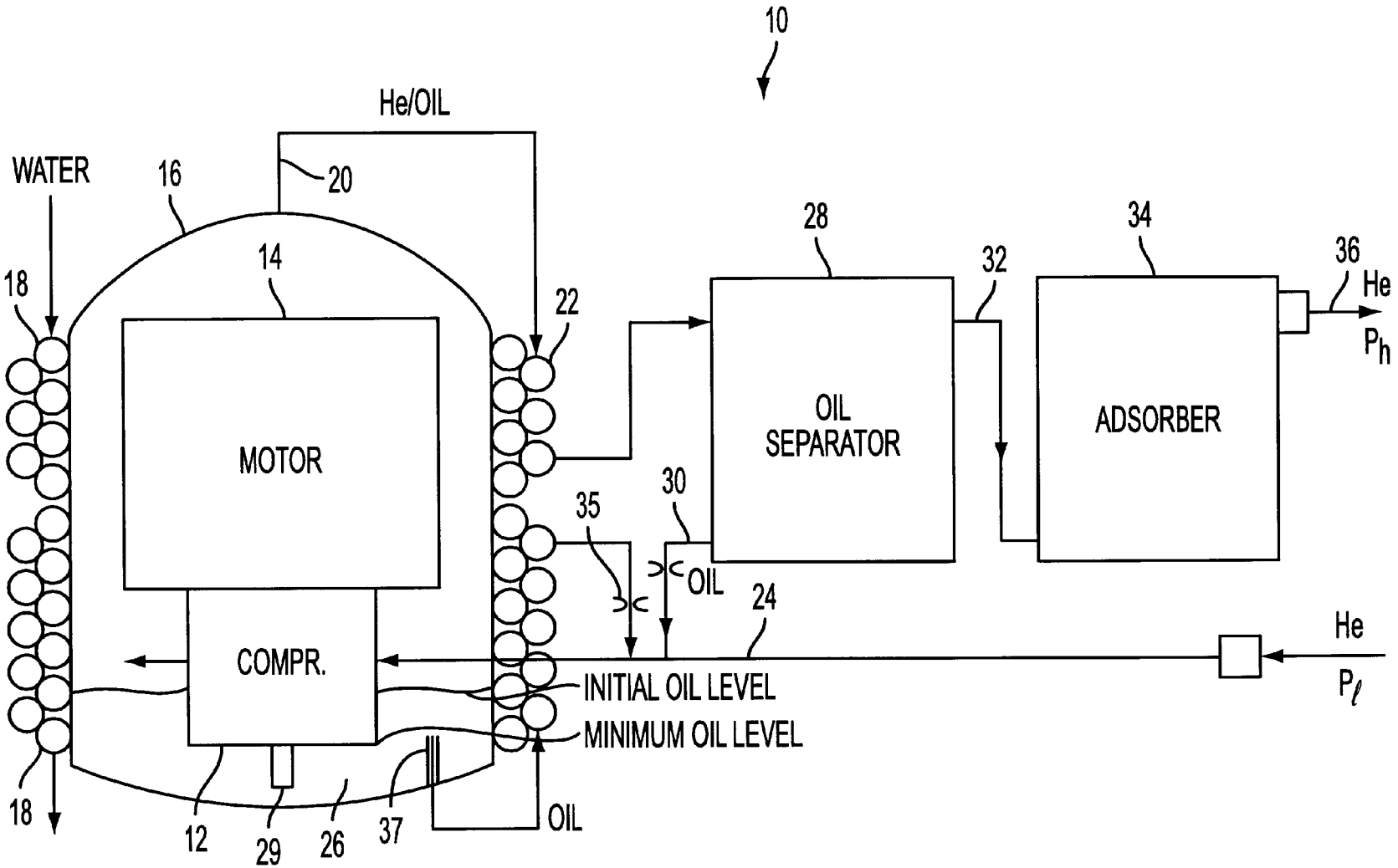
FIG. 1 is a semi-schematic diagram of an improved oil-lubricated helium compressor unit in accordance with the invention.

With reference to FIG. 1, an oil-lubricated helium compressor unit 10 in accordance with the invention includes a compressor 12 driven by a motor 14 and contained in a compressor housing 16. A cooling coil 18 is wrapped in heat transfer relationship around the compressor housing 16 for circulation of a coolant, for example, water, therethrough to carry away heat from the compressor motor.

A discharge line 20 from the compressor 12 carries high-pressure gas to an aftercooler coil 22 that is in heat transfer relationship with the cooling coil 18. A return or suction line 24 brings low-pressure gas to the compressor 12 in the known manner.

A pool of oil 26 in a sump at the bottom of the housing 16 is at a level such that the lubricating oil inlet 29 for the compressor 12 is supplied with oil during the operation of the compressor. The oil in the sump at high pressure enters an oil cooling loop 39 at the inlet 37. The oil flows in thermal contact with the cooling circuit 18 wherein a coolant, for example, water, is circulated. The oil returns to the low pressure gas return line 24 through a metering orifice 35.

The oil 26 lubricates the compressor, but a portion of the oil carries over with the compressed gas, generally helium, in the discharge line 20. It is necessary that the carryover oil be eliminated before the compressed gas is delivered to the refrigerator (not shown) for use in cooling a load.

To this end, the oil and gas leaving the aftercooler 22 enter an oil separator 28 near the top. The oil is separated from the compressed gas in the separator by known techniques which are not a novel portion of the present invention and, accordingly, are not described in detail herein. Oil, which has been separated in the oil separator 28, leaves the separator by the line 30 and enters the compressor suction line 24. The gas oil mixture is compressed and discharged into the compressor housing where most of the oil separates from the gas and collects in the sump. Thereby, oil is re-circulated to the compressor sump.

However, a small fraction of the oil that enters the oil separator with the compressed gas leaves the oil separator 28 in the compressed gas via the line 32, a net outflow from the compressor. This gas/oil mixture enters an adsorber 34 that is sized to remove all of the oil from the compressed gas and to retain the oil. Thus, oil-free compressed gas (helium) leaves the adsorber 34 by its discharge line 36 that connects with the refrigerator. After the gas is used in the refrigerator for cooling purposes, the gas returns at reduced pressure to the compressor through suction line 24. The complete refrigeration system, for example, a GM type refrigerator, is not shown in the present application, and is not a novel portion of this invention.

Figure 2:
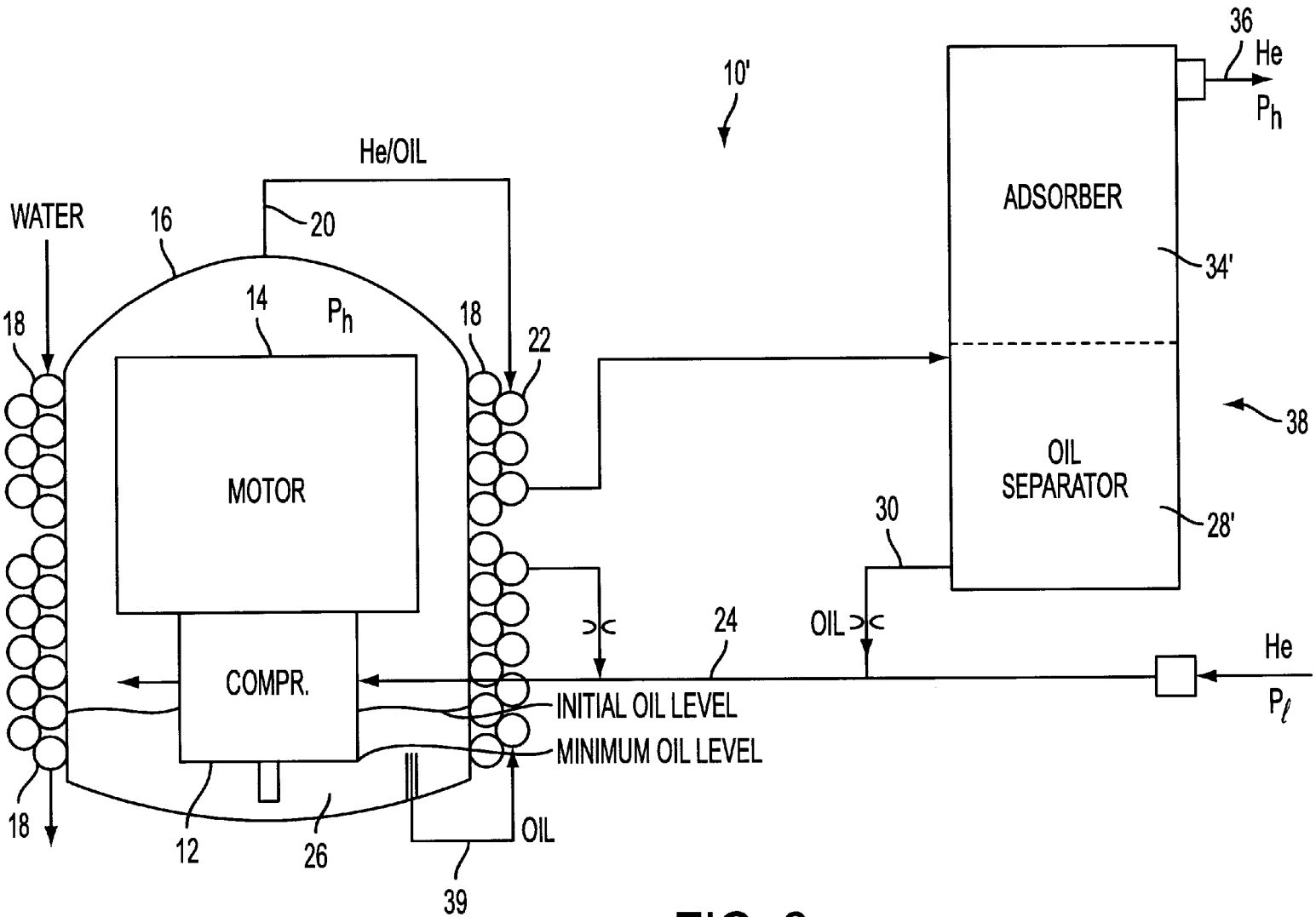
FIG. 2 is an alternative embodiment of an improved oil-lubricated helium compressor unit in accordance with the invention.

FIG. 2 illustrates an alternative embodiment of an oil-lubricated helium compressor unit in accordance with the invention that is substantially similar to the embodiment of FIG. 1, except that the adsorber 34' and oil separator 28' are an integrated unit 38 that duplicates the performance of the separate elements 28, 34 in FIG. 1. The interconnecting oil/gas line 32 of FIG. 1 is part (not shown) of the internal construction of the integrated unit 38.

Because the adsorber 34' is sized to operate for the intended life of the system without servicing it is possible to integrate the two functions in a single housing. Reduced complexity, size, and cost are the result.

Figure 3:
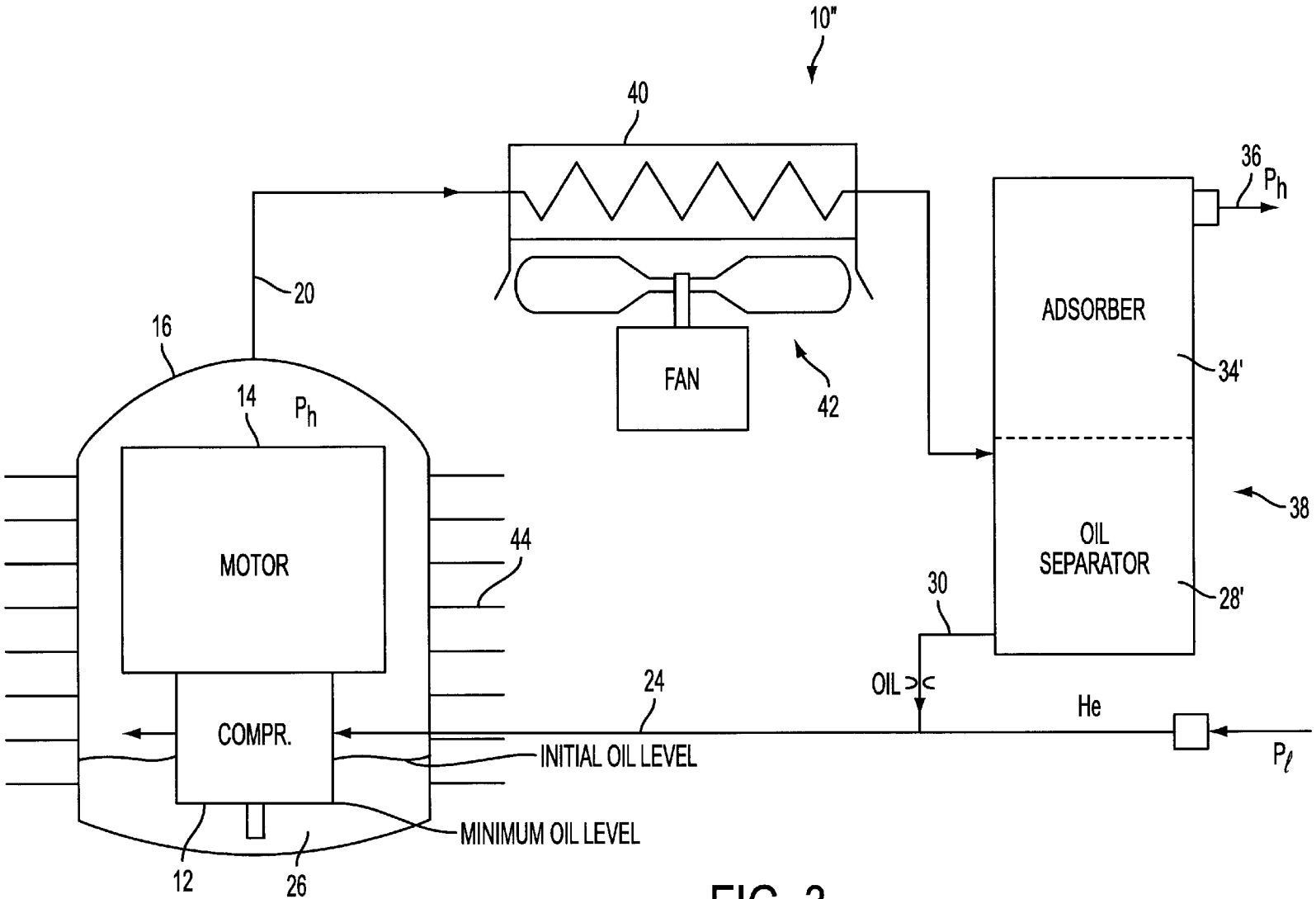
FIG. 3 is another alternative embodiment of an improved oil-lubricated helium compressor unit in accordance with the invention.

FIG. 3 is another alternative embodiment of an oil-lubricated helium compressor unit in accordance with the invention wherein the gas/oil discharge from the compressor 12 by way of the discharge line 20 is air-cooled in a heat exchanger 40 that is cooled by a fan 42. The compressor 12 is cooled by fins 44 that extend from the compressor housing 16 and rely upon forced convection from the fan. Otherwise, the unit 10" is similar to the embodiment of FIG. 2.

Figure 4:
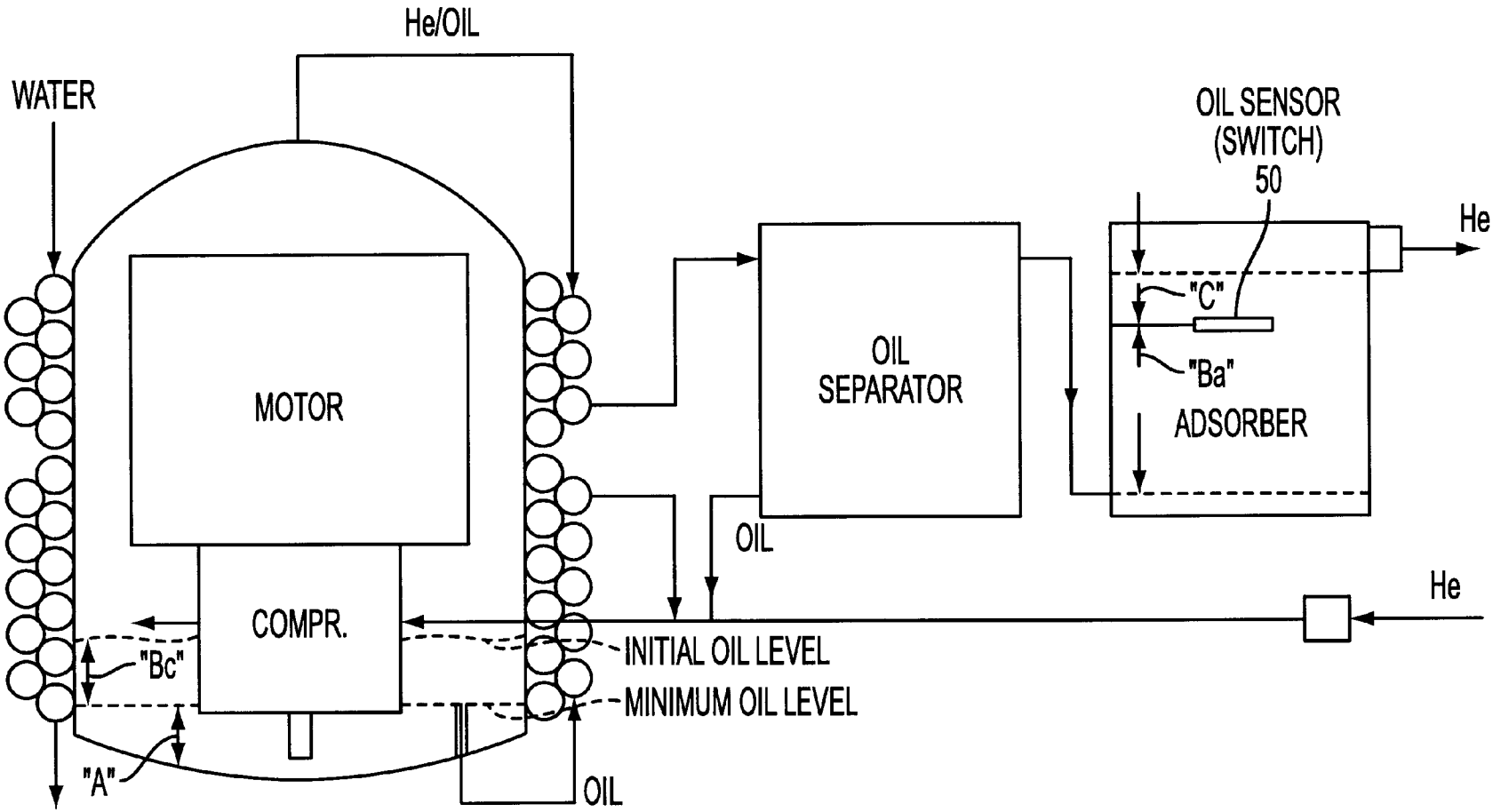
FIG. 4 is another alternative embodiment of an improved oil-lubricated helium compressor unit in accordance with the invention.

FIG. 4 is another alternative embodiment of an oil-lubricated helium compressor unit in accordance with the invention wherein an oil level sensing switch 50 has been embedded in the adsorber to sense the presence of oil at a predetermined level. Sensor 50 is connected to the compressor control circuit to shut down the compressor in the event that an amount of oil designated as "Ba" is transferred from the compressor to the adsorber. The adsorber is designed to retain an additional amount of oil designated as "C" as a safety margin to assure that oil never leaves the adsorber.

Figure 5A:
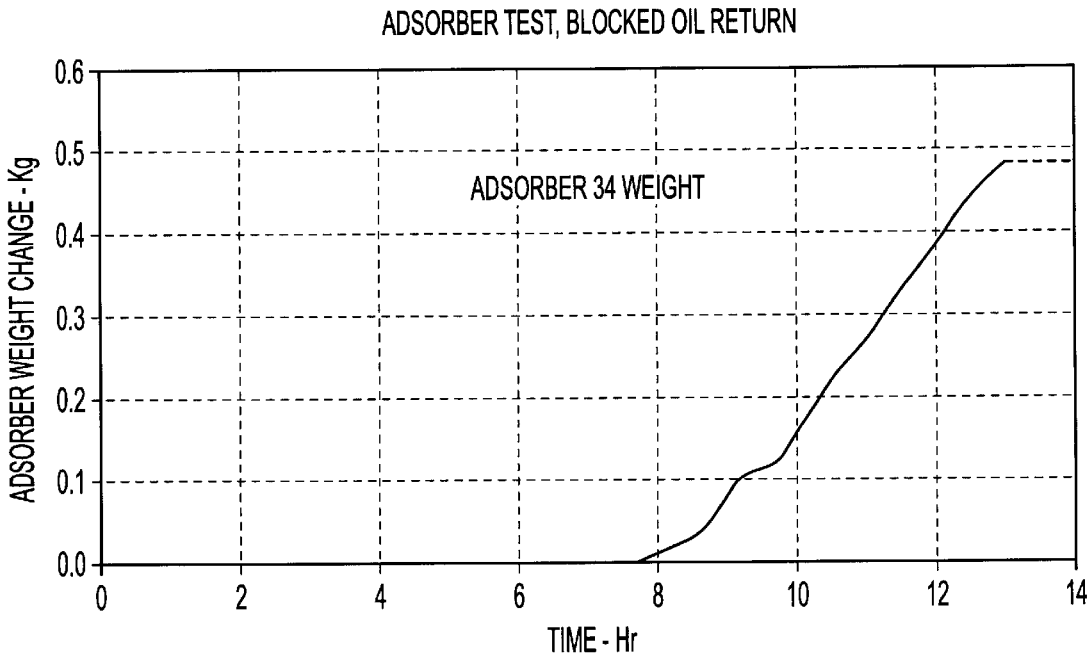
FIGS. 5*a,b* are test data showing the ability of an adsorber to retain oil at the rate oil is coming from the compressor.

FIGS. 5*a,b* are graphs of experimental data taken with an oil lubricated scroll compressor having a displacement of 10 cfm (283 L/m) compressing helium from 100 to 320 psig (0.8 to 2.3 Mpa) at room temperature. High pressure helium with entrained oil flows from the compressor through a water cooled after-cooler then through an oil separator and adsorber similar to the arrangement shown in FIG. 1. For this test a shutoff valve was added to the oil return line 30 from the oil separator and a small secondary adsorber (not shown) was installed down stream of the main adsorber. The oil separator 28 had a sight tube mounted on the outside so the oil level could be measured. Both the main adsorber and the secondary adsorber were connected with self-sealing couplings so they could be removed and weighed. Previous tests showed that at these operating pressures oil is transferred from the compressor to the separator at a rate of about 110 g/hr.

At time 0 the oil return valve was closed and at 30 minute intervals the compressor was stopped and both adsorbers were weighed. The weight of the main adsorber 34 vs. time is plotted in FIG. 5*a* and the weight of the secondary adsorber vs. time is plotted in FIG. 5*b*. With reference to FIG. 5*a*, there was no measureable transfer of oil from the separator 28 to the adsorber 34 for 8 hours. Approximately 880 g of oil collected in the bottom of the oil separator 28 and rose to about the middle of the cartridge type separator element, which was oriented vertically. Over the next 5 hours oil accumulated in the adsorber 34 at a rate of more than 100 g/hr and the oil level in the separator 28 remained constant.

Figure 5B:
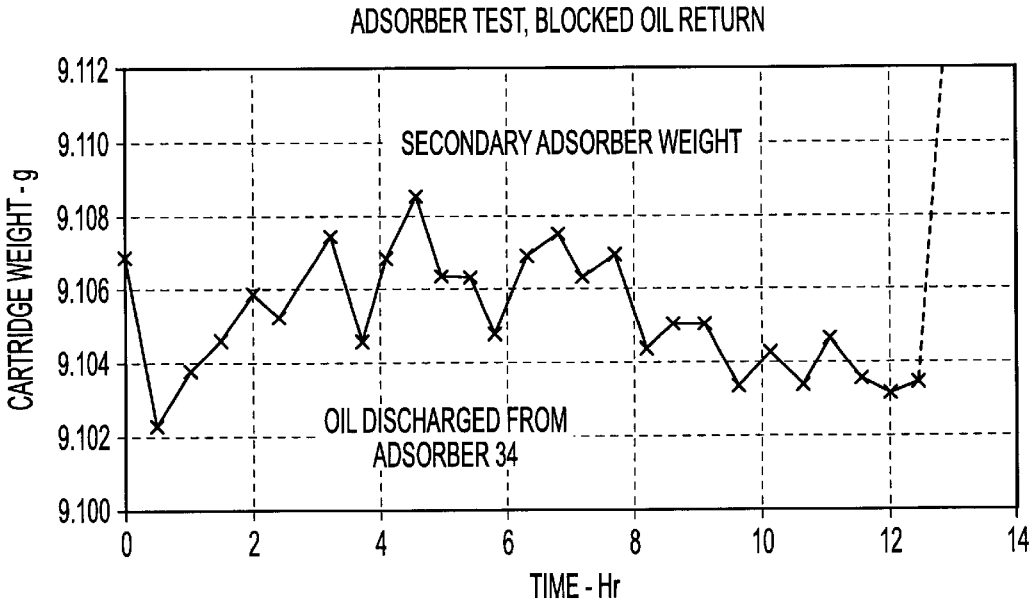

With reference to FIG. 5*b*, it is seen that within measurable limits no oil left the adsorber until some time between 12.5 and 13 hours. The amount of oil retained by the adsorber 34, 440 g, is close to the calculated design value, based on all of the inner adsorber bed being saturated. Gas velocity in the bed is about 50 ft/minute (0.25 m/s). The sharp transition from dry gas leaving the adsorber 34 at approximately 12.5 hours to wet gas at the design capacity of the adsorber indicates that a design that limits the maximum amount of oil that can enter the adsorber to 80% of its capacity would provide a very good margin of safety.

In order to meet the objectives of the present invention, that is, extended life without failure or servicing, and without risk of failure, certain requirements must be satisfied. It should be understood that "failure" in this case represents a carryover of oil leaving the adsorber 34 with the compressed gas at the discharge line 36 during the entire intended operating life of the helium compressor unit 10. For purposes of this application, failure does not include mechanical or electrical failures of a motor/compressor or failure of the oil separator 28 to properly separate oil from the compressed gas. As stated, failure is a carryover of oil leaving the adsorber 34 with the compressed gas. Such a failure can cause considerable damage to the downstream cooling system.

In the figures, the minimum oil level , denoted by "A", is an amount (FIG. 4) of oil required in the compressor housing so that the compressor does not shut down. Shutdown could be caused by several different factors such as a) an oil level switch, b) the oil dropping below the inlet to the cooling circuit 37 which might cause a shut down due to overheating or a switch that senses the lack of oil circulation, or c) the oil level drops below the lubrication pump inlet 29 and the bearings seize. The initial oil level represents the amount of oil above the minimum oil level, designated as "Bc". The actual oil level in the compressor during operation drops from the initial oil level toward the minimum oil level as a result of the difference (net outflow) between the oil leaving the housing via the discharge line 20 and the oil returning to the housing via the suction line 24.

Accordingly, the drop in oil level from the initial level toward the minimum oil level corresponds to the amount of oil that leaves the oil separator 28 via the oil/gas line 32 and enters the adsorber 34. There the oil is retained while, at the same time, the oil-free gas, at high pressure, leaves by the gas discharge line 36.

The adsorber 34 may be sized so that the amount of oil in the compressor housing 16 at start up above the minimum oil level, amount "Bc", can be entirely contained in the adsorber 34. Thus, a properly sized adsorber 34 makes it impossible for oil to carry over to the connected refrigeration system by way of the line 36. The compressor, if run continuously, will shut down after the minimum oil level is reached in the compressor housing, but there is no oil overflow from the adsorber.

Alternatively the adsorber may be designed with an oil level switch inside that will shut down the compressor when an amount of oil "Ba" is transferred to it. "Ba" may be more or less than "Bc" but the smaller of the two values that causes a shut down is designated as "B"

Sizing of the adsorber 34 takes into account the normal expected variations in oil separator efficiency, normal variations in the amount of oil carried over from the compressor in the discharge line 20, normal variations during manufacture in charging oil into the compressor housing 16, normal variations in oil volume caused by temperature changes, etc. A suitable safety factor must be selected to account for these variables when sizing the adsorber in order to reduce component size and cost.

As indicated, the adsorber 34 is capable of holding at least an amount "B" of the oil in the system in excess of the quantity represented by the minimum oil level. Additionally to volumetric capacity, the adsorber 34 must be able to retain oil entering from the line 32 at a rate corresponding to the oil output from the compressor by way of the discharge line 20. If, for some reason, the oil separator 28 completely malfunctions such that no oil is returned to the compressor housing 16 by way of the lines 30, 24, all of the compressor-pumped oil will go directly to the adsorber. The adsorber is capable of physically holding all the oil, but the adsorber 34 must be able to receive the oil at the rate at which the compressor 12 delivers oil. Otherwise, oil may carry over with the compressed gas in the outlet line 36.

The systems shown in FIGS. 1 to 4 have a single oil separator 28. Therefore a failure can result in a maximum rate of oil carryover to the adsorber 34, that is, at the same rate corresponding to the oil output from the compressor by way of the discharge line 20. Oil separators may alternatively be designed to have two stages of separation, a bulk oil separator (not shown) being positioned in the flow stream between the compressor 16 and separator 28. Experience is that the typical bulk oil separator removes 75% to 90% of the oil output from the compressor. The separated oil is returned to the compressor through a line similar to line 30 but independent. If the bulk oil separator fails then the main separator 28 might have an increase in carryover rate to the adsorber but it would still be much less than 10% of the rate from the compressor. The probability of both oil separators failing at the same time is low enough that it is possible to reduce the probable maximum amount of oil that can be transferred to the adsorber 34 and the probable maximum rate at which oil is transferred, such that the "fail safe" criteria are probably met. Experience indicates that it would be easy to reduce the maximum rate to the adsorber to 10% of the rate of oil leaving the compressor. It is thus considered within the scope of this invention to include means that reduce the maximum rate at which oil can be transferred to the adsorber to some value less than the rate at which it leaves the compressor, e.g. 10%.

As indicated above, the adsorber 34 must be able to contain all of the oil that can be discharged from the compressor 12 with the assumption that (a) no oil separator is present, or (b) the oil separator is not performing, or (c) the return line 30 is obstructed.

In each of FIGS. 1,2, and 4, a circulating loop 39 is provided for cooling the oil in the bottom of the compressor housing 16 by heat exchange with the cooling coil 18 wherein a coolant, for example, water, is circulated.

FIG. 3 is another alternative embodiment of an oil-lubricated helium compressor unit in accordance with the invention wherein the gas/oil discharge from the compressor 12 by way of the discharge line 20 is air-cooled in a heat exchanger 40 that is cooled by a fan 42. The compressor 12 is cooled by fins 44 that extend from the compressor housing 16 and rely upon forced convection from a fan. Otherwise, the unit 10" is similar to the embodiment of FIG. 2.

Constructions (FIGS. 2, 3) have the advantages of fail-safe operation for the intended life of the oil lubricated helium compressor unit, and a combined separator/adsorber that permits small size and lower costs. The adsorber need not be serviced for the intended life of the unit.

It would thus be seen that the objects set forth above, among those made apparent from the preceding description, are efficiently attained and, since certain changes may be made in carrying out the above method, and in the constructions set forth without departing from the spirit and scope of the invention, it is intended that all matter contained in the above description and shown in the accompanying drawings, shall be interpreted as illustrative and not in a limiting sense.

It is also to be understood that the following claims are intended to cover all of the generic and specific features of the invention herein described.

What is claimed is:

1. An oil lubricated gas compressor unit, comprising:

an oil lubricated gas compressor in a housing having an oil sump, a minimum quantity A of oil being required in said sump for operation of the compressor, an initial charge of oil in said compressor exceeding quantity A, said compressor outputting compressed gas containing a first fraction of said lubricating oil as an oil carryover;

an oil separator being input said compressed gas and said first oil carryover fraction from said compressor and outputting said compressed gas together with a second fraction of said lubricating oil, a remainder separated from said first fraction being returned to said compressor housing from said oil separator;

an adsorber being input said compressed gas and said second oil carryover fraction, said adsorber being sized to contain at least approximately 25% more oil than a quantity B which will cause a shutdown when transferred from said compressor, said compressed gas leaving said absorber oil never leaving the adsorber in operation of said unit.

2. A compressor unit as in claim 1 wherein said separator and said adsorber in combination have a design life in said oil lubricated gas compressor unit equal to a quotient of said quantity B divided by the rate w2 of said second oil carryover fraction.

3. A compressor unit as in claim 2, wherein B is equal to or less than the initial charge reduced by A.

4. A compressor unit as in claim 1, wherein a rate capability of oil adsorbing and retention of said adsorber at least equals approximately 10% of the rate w1 of oil output in said first fraction from said compressor.

5. A compressor unit as in claim 1, wherein said oil lubricated gas compressor unit initially contains said quantity of oil B equal to a product of a preselected minimum design life for said compressor unit multiplied by a quantity of oil per unit time of said second oil carryover fraction B1, plus a quantity B2, added as a safety factor.

6. A compressor unit as in claim 1 wherein quantities are measured in one of weight and volume units.

7. A method of delivering oil-free compressed refrigerant gas comprising the steps of:

providing an oil lubricated gas compressor in a housing having an oil sump, a minimum quantity A of oil being required in said sump to provide oil at a lubricating oil inlet of said compressor;

adding an initial charge of oil in said compressor exceeding said quantity A;

operating said compressor to output compressed gas, said compressed gas containing a first fraction of said lubricating oil as an oil carryover;

inputting said compressed gas and said first oil carryover fraction from said compressor to an oil separator and outputting from said separator said compressed gas together with a second fraction of said lubricating oil;

returning a remainder separated from said first fraction to said compressor housing from said oil separator;

inputting to an adsorber said compressed gas and said second oil fraction from said separator, said adsorber being sized to contain at least 25% more oil than a quantity B which will cause a shut down when transferred from said compressor.

8. A method as in claim 7, wherein said separator and said adsorber in combination have a design life in said oil lubricated gas compressor unit equal to a quotient of said quantity B divided by the rate w2 of said second oil carryover fraction.

9. A method as in claim 8, wherein said oil lubricated gas compressor unit initially contains said quantity of oil B euqal to a product of a preselected minimum design life for said compressor unit multiplied by a quantity per unit time of said second oil fraction, B1, plus a quantity B2 added as a safety factor.

10. A method as in claim 7, wherein a rate capability of oil adsorbing and retention of said adsorber at least equals approximately 10% of the rate of oil output in said first fraction, w1, from said compressor.

11. A method as in claim 7, further comprising the step of charging said oil lubricated gas compressor unit initially with said quantity of oil B equal to a product of a preselected design life for said compressor unit multiplied by a quantity per unit time of said second oil carryover fraction B1, plus a quantity B2 added as a safety factor.

12. A compressor unit as in claim 1 wherein the separator and the adsorber are housed in separate enclosures.

* * * * *